US008061415B2

(12) United States Patent
Hancock

(10) Patent No.: US 8,061,415 B2
(45) Date of Patent: Nov. 22, 2011

(54) PLATE FIN WITH HYBRID HOLE PATTERN

(75) Inventor: Stephen S. Hancock, Flint, TX (US)

(73) Assignee: Trane International, Inc., Piscataway, NJ (US)

( * ) Notice: Subject to any disclaimer, the term of this patent is extended or adjusted under 35 U.S.C. 154(b) by 182 days.

(21) Appl. No.: 12/493,890

(22) Filed: Jun. 29, 2009

(65) Prior Publication Data

US 2010/0326643 A1 Dec. 30, 2010

(51) Int. Cl.
*F28D 1/04* (2006.01)

(52) U.S. Cl. ..... 165/151; 165/910

(58) Field of Classification Search ..... 165/151, 165/910

See application file for complete search history.

(56) References Cited

U.S. PATENT DOCUMENTS

| | | | | |
|---|---|---|---|---|
| 2,520,821 A | | 8/1950 | Woods et al. | |
| 2,963,277 A | * | 12/1960 | Heller et al. | 165/151 |
| 4,836,277 A | * | 6/1989 | Koehler | 165/151 |
| 5,056,594 A | | 10/1991 | Kraay | |
| 5,205,138 A | | 4/1993 | Besore et al. | |
| 5,222,550 A | * | 6/1993 | Griffin et al. | 165/151 |
| 5,327,957 A | | 7/1994 | Killebrew | |
| 5,975,198 A | * | 11/1999 | Kim et al. | 165/151 |
| 6,644,389 B1 | | 11/2003 | Kang et al. | |

FOREIGN PATENT DOCUMENTS

| | | |
|---|---|---|
| JP | 2003021485 A | 1/2003 |
| JP | 2003329334 A | 11/2003 |
| JP | 2007162961 A | 6/2007 |

OTHER PUBLICATIONS

PCT International Search Report; PCT Application No. PCT/US2010/040310; Jan. 24, 2011; 3 pgs.

PCT Written Opinion of the International Searching Authority; PCT Application No. PCT/US2010/040310; Jan. 24, 2011; 3 pgs.

* cited by examiner

*Primary Examiner* — Cheryl J Tyler
*Assistant Examiner* — Brandon M Rosati
(74) *Attorney, Agent, or Firm* — Conley Rose, P.C.; J. Robert Brown, Jr.

(57) ABSTRACT

A fin having a leading edge, a trailing edge opposing the leading edge, and a plurality of leading holes substantially centered along a leading axis. The fin further having a plurality of secondary holes substantially centered along a secondary axis, the secondary axis being substantially parallel to the leading axis and located between the leading axis and the trailing edge, the plurality of secondary holes being located so that the plurality of leading holes and the plurality of secondary holes form a substantially rectangular matrix. The fin further having a plurality of trailing holes substantially centered along a trailing axis, the trailing axis being substantially parallel to at least one of the leading axis and the secondary axis and located between the secondary axis and the trailing edge, each of the plurality of trailing holes being substantially equidistant from the respective two nearest secondary holes.

14 Claims, 9 Drawing Sheets

PLATE FIN WITH HYBRID HOLE PATTERN

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND

Conventional air conditioning systems generally comprise a compressor, a condenser coil, a condenser fan for passing air through the condenser coil, a flow restriction device, an evaporator coil, and an evaporator blower for passing air through the evaporator coil. The condenser coil and the evaporator coil are each designed as heat exchangers with internal tubing for carrying refrigerant. Further, evaporator coils and condenser coils sometimes comprise a plurality of plate fins disposed along a length of the internal tubing so that the internal tubing passes through holes formed in the adjacent plate fins. The major components of the air conditioning system can be grouped and located in different manners, but two arrangements are most prevalent.

A "split-system" is generally an air conditioning system in which the compressor, the condenser coil, and the condenser fan are colocated within a single housing, often referred to as a condensing unit. In the split-system, the evaporator coil, the flow restriction device, and the evaporator blower are also colocated within a single housing, often referred to as an air handling unit or air handler. Some air handling units or air handlers comprise heat generators such as electrically resistive heating elements and/or gas furnace elements so that the evaporator coil and the heat generators are both in an airflow path of the evaporator blower. In most applications of a split-system, the condensing unit is located outside the space to be temperature controlled while the air handling unit circulates and conditions air within the space to be temperature controlled. More specifically, it is common for the condensing unit to be located outside the building or structure that is to be temperature controlled while the air handling unit is typically located within a closet, attic, or other location within the building.

Alternatively, a conventional air conditioning system may be configured as a "package unit" where all of the components of the air conditioning system are colocated within a single housing. Package units are typically, but not necessarily, installed in a location exterior to the space to be temperature controlled.

Regardless of the type of air conditioning system, the principles of operation remain the same. Generally, the compressor operates to compress refrigerant into a hot and high pressure gas, which is passed through the internal tubing of the condenser coil. As the refrigerant is passed through the condenser coil, the condenser fan operates to pass ambient air across the condenser coil, thereby removing heat from the refrigerant and condensing the refrigerant into liquid form. The liquid refrigerant passes through a flow restriction device, which causes the refrigerant to transform into a colder and lower pressure liquid/gas mixture that proceeds to the evaporator. As the mixture is passed through the evaporator coil, the evaporator blower forces ambient air across the evaporator coil, thereby providing a cooling and dehumidifying effect to the ambient air, which is then distributed to the space to be temperature controlled.

SUMMARY OF THE DISCLOSURE

In one aspect, a fin is disclosed that comprises a leading edge, a trailing edge opposing the leading edge, and a plurality of leading holes substantially centered along a leading axis. The fin further comprises a plurality of secondary holes substantially centered along a secondary axis, the secondary axis being substantially parallel to the leading axis and located between the leading axis and the trailing edge, the plurality of secondary holes being located so that the plurality of leading holes and the plurality of secondary holes form a substantially rectangular matrix. Still further, the fin comprises a plurality of trailing holes substantially centered along a trailing axis, the trailing axis being substantially parallel to at least one of the leading axis and the secondary axis and located between the secondary axis and the trailing edge, each of the plurality of trailing holes being substantially equidistant from the respective two nearest secondary holes.

In another embodiment, a fin is disclosed that comprises a fin width extending between a leading edge and a trailing edge, a plurality of leading holes centered along a leading axis, a plurality of secondary holes positioned along a secondary axis between the leading axis and the trailing edge, and a plurality of additional holes positioned between the secondary axis and the trailing edge. Each of the plurality of secondary holes substantially aligns with a corresponding one of the plurality of leading holes along a path substantially parallel to the fin width. Further, each of the plurality of additional holes is positioned so as to avoid interference with airflow plumes formed at each of the plurality of secondary holes through which a separate refrigerant tube extends when airflow is directed across the fin at an acute incident angle with respect to the leading axis.

In yet another embodiment, a fin is disclosed that comprises a fin width extending between a leading edge and a trailing edge, and a plurality of holes each configured to receive a separate refrigerant tube, at least some of the plurality of holes being centered along a leading axis, a secondary axis and a tertiary axis. Further, the plurality of holes are positioned on the fin so as to prevent interference between airflow plumes created at each of the plurality of holes through which a refrigerant tube extends when airflow is directed across the fin at an acute incident angle with respect to the leading axis.

In another aspect, a heat exchange system is disclosed that comprises a plurality of fins. In yet another aspect, an air conditioning system is disclosed that comprises a fin.

BRIEF DESCRIPTION OF THE DRAWINGS

For a more detailed description of the various embodiments of fin and tube assemblies disclosed herein, reference will now be made to the accompanying drawings, wherein.

DETAILED DESCRIPTION

In some applications, heat exchangers (i.e., evaporator or condenser coils) comprise a plurality of fins that are arranged so that adjacent fins are substantially parallel to each other and offset by a fin pitch distance, and a plurality of refrigerant tubes disposed generally orthogonally to the plurality of fins. Most generally, a fin may be described as a thin plate constructed of metal or other materials suitable for conducting heat and comprising a series of holes formed therein that are suitable for receiving refrigerant tubing therethrough. Accordingly, as will be described in greater detail below, a plurality of fins comprising substantially similar hole patterns may be arranged in a stack, in some embodiments with adjacent fins equally offset by the fin pitch distance, so that refrigerant tubes may each be received through corresponding holes in the plurality of fins. In other words, each refrigerant tube may be inserted substantially orthogonally through corresponding holes in the stack of fins so that the fins are disposed along the refrigerant tubing, thereby forming what may be referred to as a slab of the heat exchanger. The holes of the fins may be located on the fins in various patterns amongst various embodiments of heat exchangers and the hole patterns may effect a heat transfer property of the fin, slab, and/or heat exchanger.

Figure 1A:
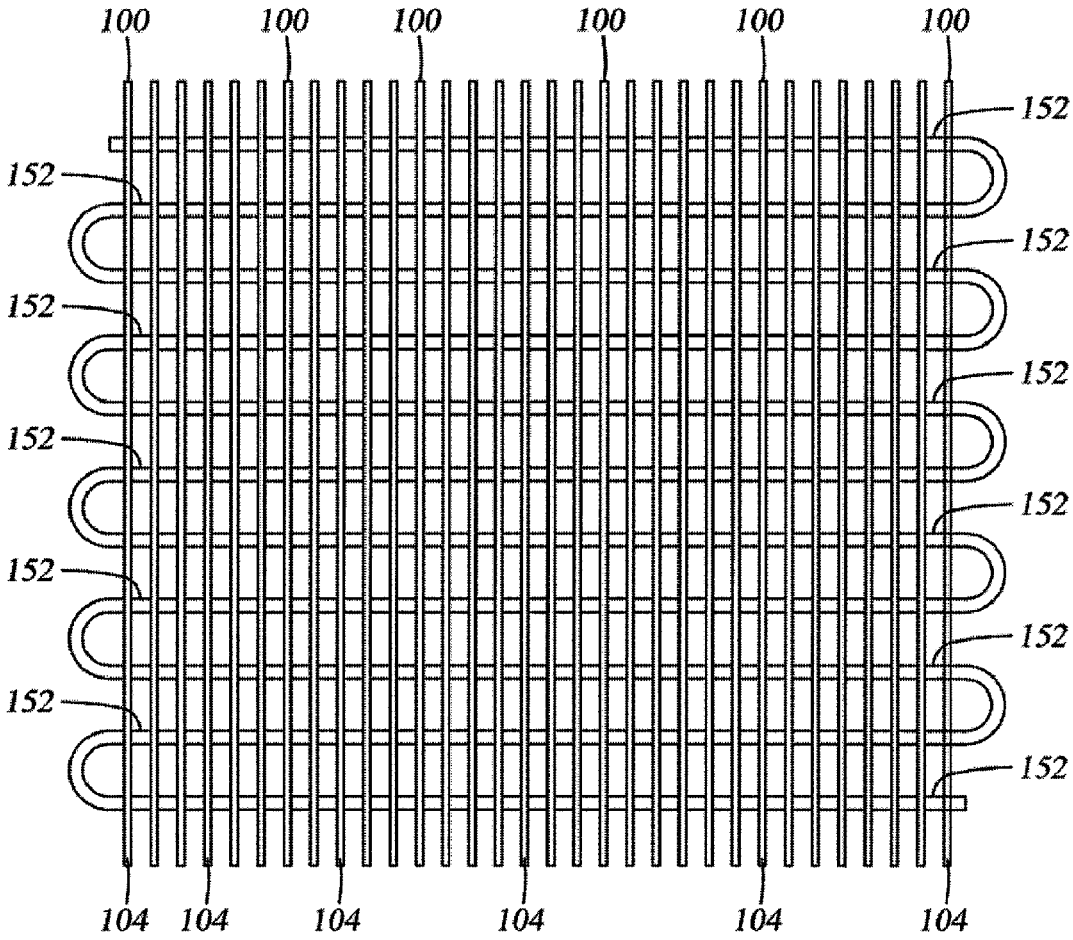
Fig. 1A (PRIOR ART)
FIG. 1A is a side view of an embodiment of a fin and tube assembly comprising fins with an in-line hole pattern.
Figure 1B:
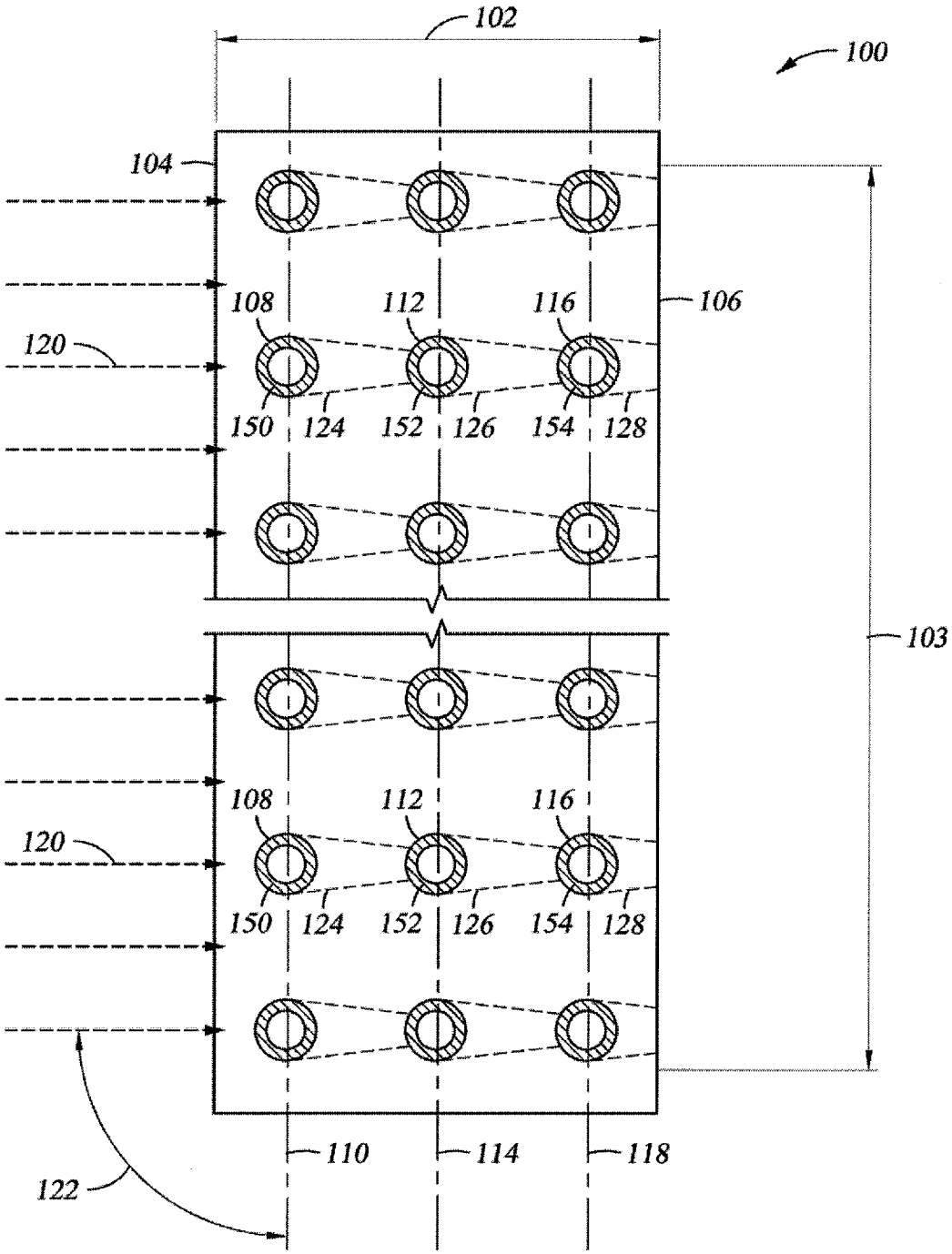
Fig. 1B (PRIOR ART)
FIG. 1B is a partial front view of an embodiment of a fin and tube assembly comprising a fin with an in-line hole pattern exposed to an orthogonal airflow.
Figure 1C:
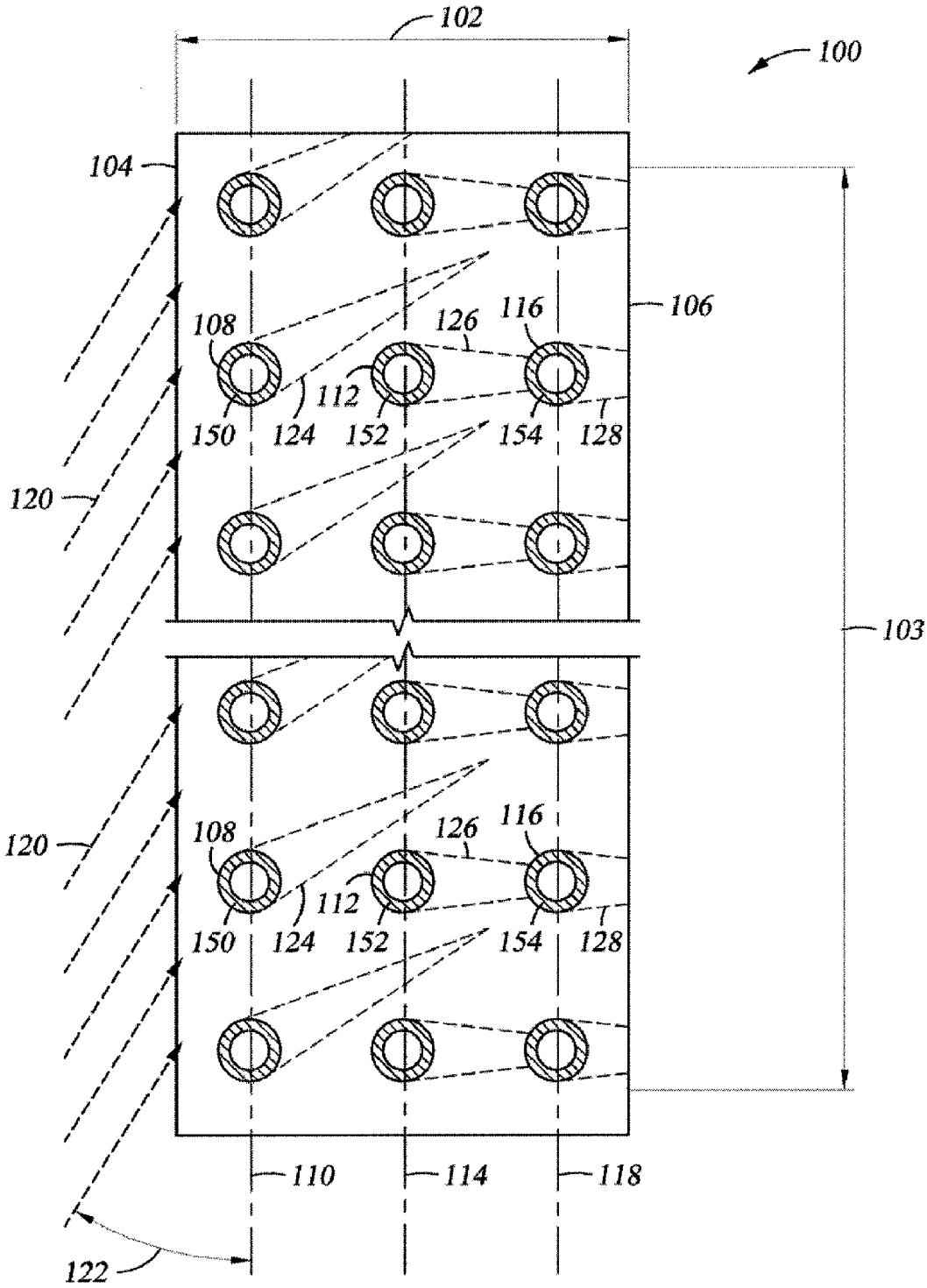
Fig. 1C (PRIOR ART)
FIG. 1C is a partial front view of the fin and tube assembly of Prior Art FIG. 1B exposed to an airflow having an acute angle of incidence.

For example, with reference to Prior Art FIG. 1A, which shows a side view of a fin and tube assembly and with reference to Prior Art FIGS. 1B-1C, which show a portion of a fin 100 of the fin and tube assembly of Prior Art FIG. 1, wherein the fin 100 comprises an in-line hole pattern. Prior Art FIG. 1A shows that a plurality of fins 100 are disposed along the length of refrigerant tubes 152. In this embodiment, the fins 100 are disposed so that adjacent fins 100 are equally spaced from one another along the length of the refrigerant tubes 152. The fin 100 has a width 102 that extends generally between a leading edge 104 and a trailing edge 106. A plurality of leading holes 108 are disposed in a leading column along a length 103 of the fin 100 that extends generally orthogonally to the width 102. The leading holes 108 are generally aligned with their centers located on a leading axis 110 that is, in this embodiment, substantially parallel to the leading edge 104 and the trailing edge 106. Further, a plurality of secondary holes 112 are disposed in a secondary column along the length 103 of the fin 100, and the holes 112 are generally aligned with their centers located on a secondary axis 114 that is, in this embodiment, substantially parallel to the leading axis 110. Still further, a plurality of trailing holes 116 are disposed in a third column along the length 103 of the fin 100, and the trailing holes 116 are generally aligned with their centers located on a trailing axis 118 that is, in this embodiment, substantially parallel to the secondary axis 114. In this in-line hole pattern embodiment, each secondary hole 112 lies substantially aligned with an associated leading hole 108 along a path substantially parallel to the width 102 of the fin 100. Similarly, each trailing hole 116 lies substantially aligned with an associated secondary hole 112 along a path substantially parallel to the width 102 of the fin 100. In this manner, the holes 108, 112, 116 are substantially disposed in a rectangular array or matrix pattern.

Referring now to Prior Art FIG. 1B, an incoming airflow 120 (represented by arrows labeled 120) is introduced to the fin and tube assembly to flow generally orthogonally across the fin 100. The orthogonal nature of the airflow 120 is determined by an angle of incidence 122 measured between the direction of orthogonal airflow 120 and the leading axis 110. In this case the angle of incidence is about 90 degrees. In this embodiment, as orthogonal airflow 120 contacts refrigerant tubes 150 that extend orthogonally through leading holes 110 of a plurality of fins 100, leading plumes 124, also referred to as thermal drafts, are formed which represent regions of decreased airflow and temperature. Leading plumes 124 extend along the width 102 of the fin 100 and contact refrigerant tubes 152 that extend through secondary holes 112. Due to the secondary holes 112 and the refrigerant tubes 152 carried therein being contacted by the leading plumes 124, heat transfer efficiency between the refrigerant tubes 152 and the airflow 120 is decreased. Similarly, secondary plumes 126 associated with secondary holes 112 and the refrigerant tubes 152 carried therein extend along the width 102 of the fin 100 and contact refrigerant tubes 154 that extend through trailing holes 116. Due to the trailing holes 116 and the refrigerant tubes 154 carried therein being contacted by the secondary plumes 126, heat transfer efficiency between the refrigerant tubes 154 and the airflow 120 is decreased. It can further be seen that trailing plumes 128 are formed when the airflow 120 contacts the refrigerant tubes 154 carried within the trailing holes 116.

Referring now to Prior Art FIG. 1C, by altering the angle of incidence 122 of the airflow 120 to have an acute angle value, it can be seen that leading plumes 124 do not contact the refrigerant tubes 152 carried within secondary holes 112. However, it can further be seen that the secondary plumes 126 continue to contact the refrigerant tubes 154 carried within trailing holes 116 despite the change in the angle of incidence 122 of the incoming airflow 120 since the airflow direction becomes orthogonal as the air passes through the fin. Accordingly, while changing the angle of incidence 122 of the incoming airflow 120 from about 90 degrees to an acute angle increases heat transfer efficiency since the leading plumes 124 no longer contact the refrigerant tubes 152 carried within secondary holes 112, some heat transfer inefficiency still remains due to the secondary plumes 126 contacting the refrigerant tubes 154 carried within trailing holes 116. Nonetheless, it will be appreciated that for heat exchangers comprising fins 100 with an in-line hole pattern, such as shown in Prior Art FIGS. 1A, 1B and 1C, greater heat transfer efficiency is achieved when the incoming airflow 120 has an acute angle rather than being orthogonal.

Figure 2A:
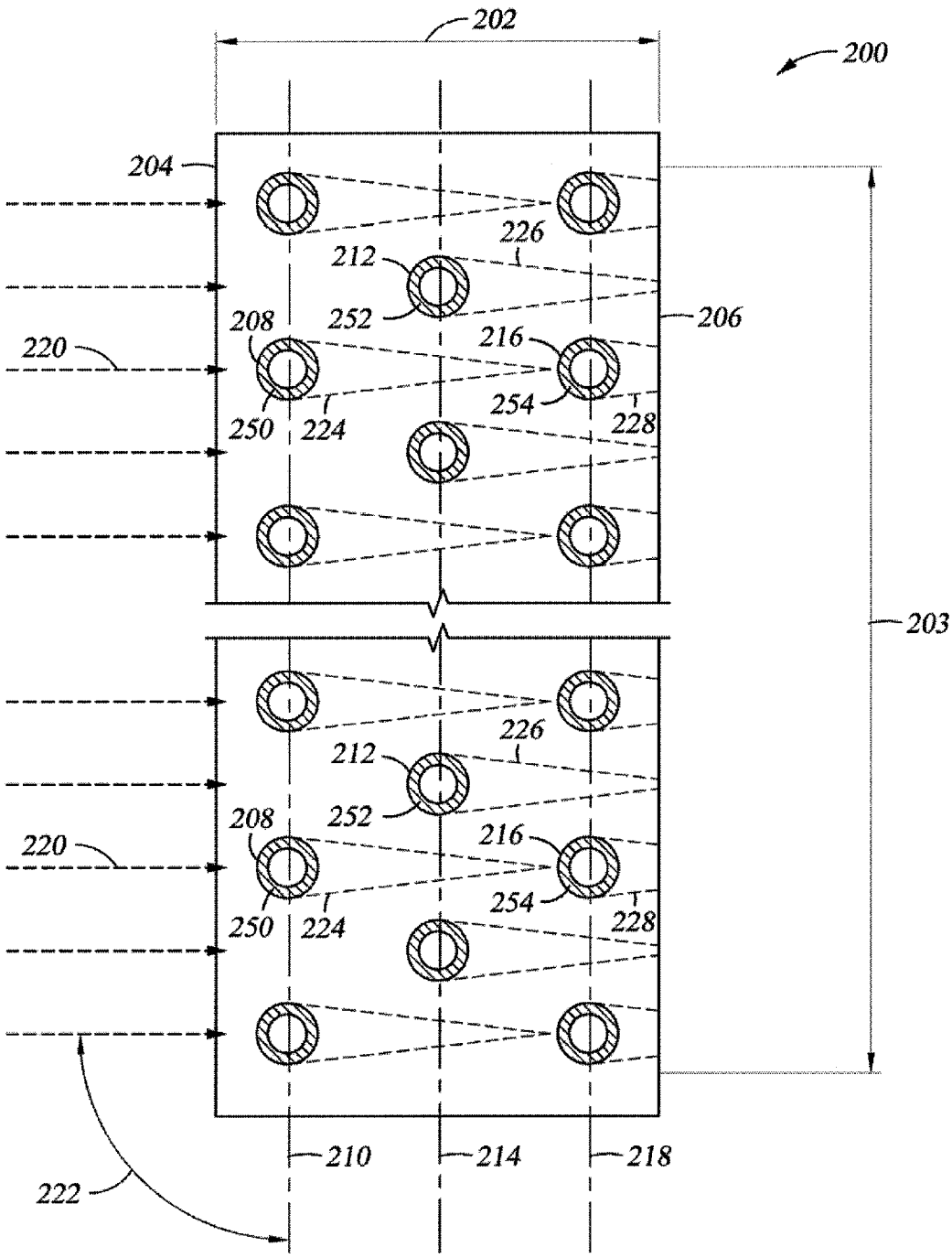
Fig. 2A (PRIOR ART)
FIG. 2A is a front view of another embodiment of a fin and tube assembly comprising a fin with an offset hole pattern exposed to an orthogonal airflow.
Figure 2B:
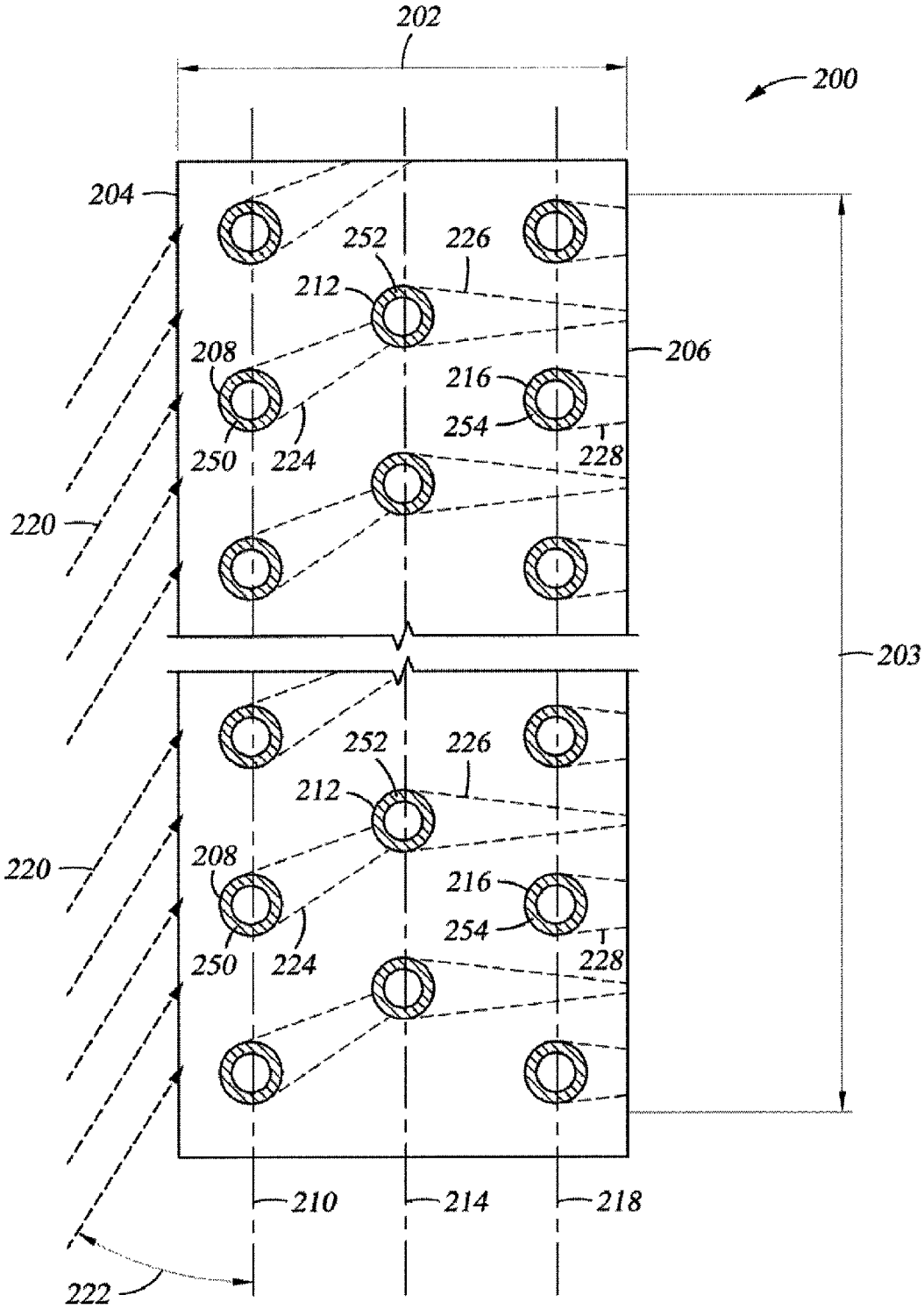
Fig. 2B (PRIOR ART)
FIG. 2B is a front view of the fin and tube assembly of Prior Art FIG. 2A exposed to an airflow having an acute angle of incidence.

Another embodiment of a fin and tube assembly is shown in Prior Art FIGS. 2A-2B. The assembly comprises a fin 200 with an offset hole pattern. The fin 200 has a width 202 that extends generally between a leading edge 204 and a trailing edge 206. A plurality of leading holes 208 are disposed in a leading column along a length 203 of the fin 200 that extends generally orthogonally to the width 202. The leading holes 208 are generally aligned with their centers located on a leading axis 210 that is, in this embodiment, substantially parallel to the leading edge 204 and the trailing edge 206.

Further, a plurality of secondary holes 212 are disposed in a secondary column along the length 203 of the fin 200, and the holes 212 are generally aligned with their centers located on a secondary axis 214 that is, in this embodiment, substantially parallel to the leading axis 210. Still further, a plurality of trailing holes 216 are disposed in a third column along the length 203 of the fin 200, and the trailing holes 216 are generally aligned with their centers located on a trailing axis 218 that is, in this embodiment, substantially parallel to the secondary axis 214. In this offset hole pattern embodiment, each secondary hole 212 lies along the secondary axis 214 so that, with respect to the location of each secondary hole 212 in the lengthwise direction, a center of each secondary hole 212 is disposed substantially centered between the two closest adjacent leading holes 208. Similarly, each trailing hole 216 lies along the trailing axis 218 so that, with respect to the location of each trailing hole 216 in the lengthwise direction, a center of each trailing hole 216 is disposed substantially centered between the two closest adjacent secondary holes 212 and disposed at substantially the same location along the lengthwise direction as an associated leading hole 208. In this manner, the holes 208, 212, 216 are substantially disposed in a staggered or offset pattern.

Referring now to Prior Art FIG. 2A, an incoming airflow 220 (represented by arrows labeled 220) is introduced to the fin and tube assembly to flow generally orthogonally across the fin 200. The orthogonal nature of the airflow 220 is determined by an angle of incidence 222 measured between the direction of orthogonal airflow 220 and the leading axis 210. In this case the angle of incidence is about 90 degrees. In this embodiment, as orthogonal airflow 220 contacts refrigerant tubes 250 that extend through leading holes 210 of a plurality of fins 200, leading plumes 224, also referred to as thermal drafts, are formed which represent regions of decreased airflow and temperature. Leading plumes 224 extend along the width 202 of the fin 200 but do not contact refrigerant tubes 252 that extend through secondary holes 212. Similarly, secondary plumes 226 associated with secondary holes 212 and the refrigerant tubes 252 carried therein extend along the width 202 of the fin 200 but do not contact refrigerant tubes 254 that extend through trailing holes 216.

Referring now to Prior Art FIG. 2B, by altering the angle of incidence 222 of the airflow 220 to have an acute angle value, it can be seen that leading plumes 224 contact the refrigerant tubes 252 carried within secondary holes 212, thereby leading to a decrease in heat transfer efficiency. However, it can further be seen that the secondary plumes 226 do not contact the refrigerant tubes 254 carried within trailing holes 216 despite the change in the angle of incidence 222 of the incoming airflow 220. Again, this is because the airflow direction becomes orthogonal as the air passes through the fin. Accordingly, changing the angle of incidence 222 of the incoming airflow 220 from about 90 degrees to an acute angle decreases heat transfer efficiency in this fin and tube assembly. Therefore, it will be appreciated that for heat exchangers comprising fins 200 with an offset hole pattern as shown in Prior Art FIGS. 2A-2B, greater heat transfer efficiency is achieved when the incoming airflow 220 is orthogonal rather than having an acute angle.

Ultimately, both types of fins 100, 200 present inefficiencies in heat exchange when exposed to airflows such as airflows 120, 220 having acute angles with respect to leading axes such as axes 110, 210, respectively. Accordingly, the present disclosure is directed to a fin having holes arranged in a pattern that provides improved heat transfer efficiency when a heat exchanger comprising a plurality of such fins is exposed to an airflow having an acute angle of incidence with regard to a leading axis along which leading holes are disposed. The present disclosure provides systems and methods for increasing heat exchanger efficiency by providing fins having hybrid hole arrangements as described below in greater detail, and by providing heat exchangers comprising such fins having hybrid hole arrangements.

Figure 3:
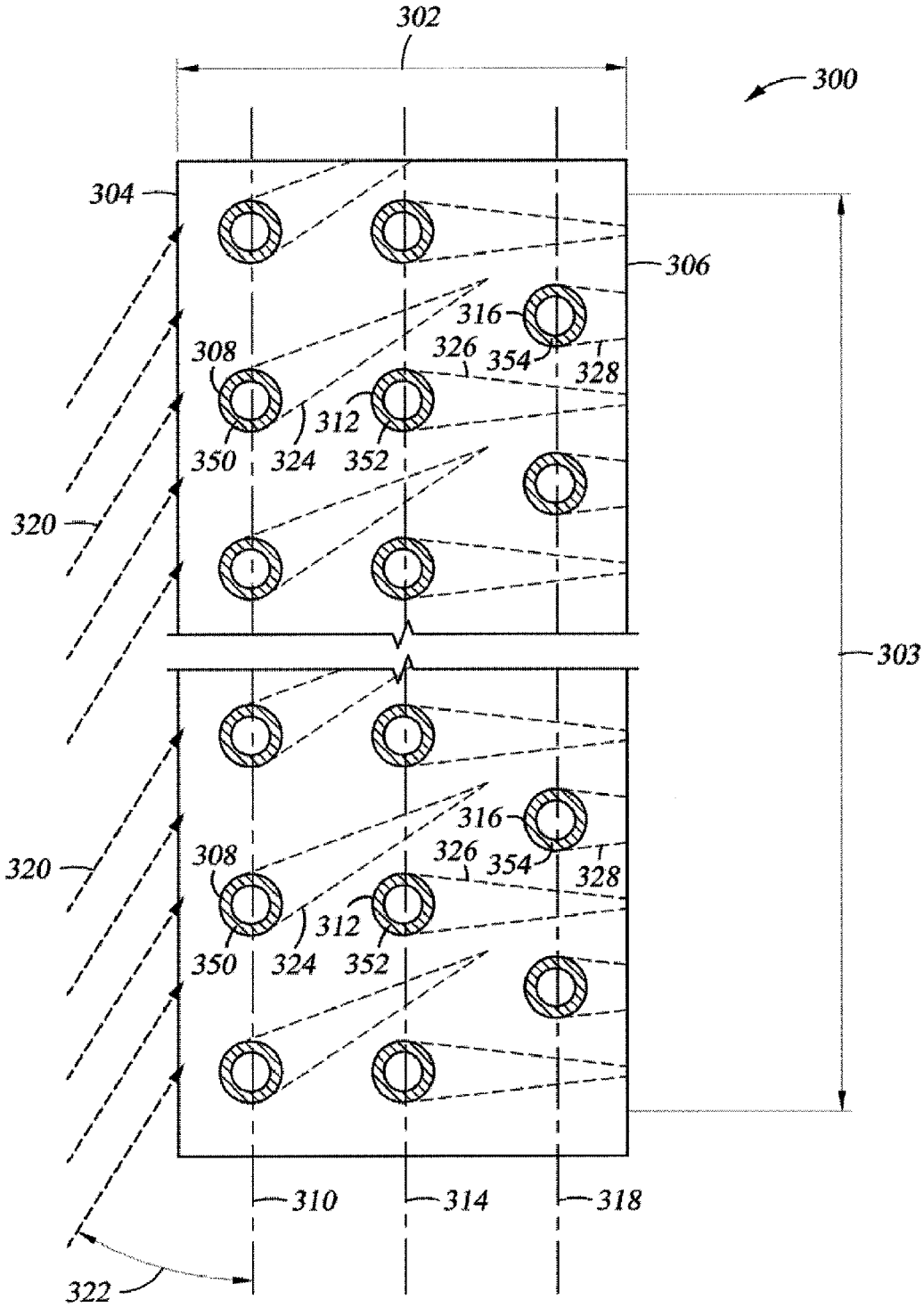
FIG. 3 is a front view of another fin and tube assembly comprising a fin with a hybrid hole pattern exposed to an airflow having an acute angle of incidence.

Referring now to FIG. 3, another embodiment of a fin and tube assembly is depicted comprising a fin 300 with a hybrid hole pattern. The fin 300 has a width 302 that extends generally between a leading edge 304 and a trailing edge 306. A plurality of leading holes 308 are disposed in a leading column along a length 303 of the fin 300 that extends generally orthogonally to the width 302. The leading holes 308 are generally aligned with their centers located on a leading axis 310 that is, in this embodiment, substantially parallel to the leading edge 304 and the trailing edge 306. Further, a plurality of secondary holes 312 are disposed in a secondary column along the length 303 of the fin 300, and the secondary holes 312 are generally aligned with their centers located on a secondary axis 314 that is, in this embodiment, substantially parallel to the leading axis 310. Still further, a plurality of trailing holes 316 are disposed in a third column along the length 303 of the fin 300, and the trailing holes 316 are generally aligned with their centers located on a trailing axis 318 that is, in this embodiment, substantially parallel to the secondary axis 314. In this hybrid hole pattern embodiment, each secondary hole 312 lies substantially aligned with an associated leading hole 308 along a path substantially parallel to the width 302 of the fin 300. In other words, each secondary hole 312 lies substantially in-line with an associated leading hole 308. However, trailing holes 316 are not in-line with adjacent secondary holes 312. Instead, trailing holes 316 lie along the trailing axis 318 so that, with regard to the location of each trailing hole 316 in the lengthwise direction of the fin 300, a center of each trailing hole 316 is disposed substantially centered between the two closest adjacent secondary holes 312. Accordingly, each of the plurality of trailing holes 316 are substantially equidistant from the respective two nearest secondary holes 312. In other words, the secondary holes 312 and trailing holes 316 are substantially disposed in a staggered or offset pattern.

In this embodiment, the angle of incidence 322 of the incoming airflow 320 has an acute angle of about 25°. However in alternative embodiments, an angle of incidence substantially similar to angle of incidence 322 may have a value within a range of about 10° to about 40° or any other suitable acute angle. Furthermore, in alternative embodiments a fin may be substantially formed as fin 300 but may be exposed to airflow having significantly different angles of incidence. In other words, a fin substantially similar to fin 300 may be exposed to airflow from one or more directions successively and/or simultaneously and may even result in airflow moving generally from a trailing edge toward a leading edge.

As shown in FIG. 3, when the airflow 320 having an acute angle of about 25° contacts the leading holes 308 and the refrigerant tubes 350 passing through holes 308, leading plumes 324 are produced that extend upward and rightward (in the orientation of FIG. 3) in a generally triangular shape and pass between the two closest adjacent secondary holes 312. However, these leading plumes 324 do not contact the refrigerant tubes 352 carried within secondary holes 312, nor do these leading plumes 324 intersect the secondary plumes 326 generated by refrigerant tubes 352. As shown, the secondary plumes 326 are also generally triangular in shape and extend rightward (in the orientation of FIG. 3) and between the two closest adjacent trailing holes 316. These secondary plumes 326 do not contact the refrigerant tubes 354 carried within trailing holes 316 nor do these secondary plumes 326 intersect the trailing plumes 328 generated by refrigerant tubes 354. The trailing plumes 328 are substantially similar in shape and angular orientation to secondary plumes 326. In particular, the trailing plumes 328 are generally triangular in shape and extend rightward without intersecting plumes 324, 326. Accordingly, the lack of overlap and/or intersection and/or contact between any of plumes 324, 326, 328 with adjacent holes 308, 312, 316 and/or refrigerant tubes 350, 352, 354 carried within such holes 308, 312, 316 provides an increase in heat transfer efficiency. More specifically, the hybrid hole arrangement of fin 300 allows each refrigerant tube 350, 352, 354 carried through holes 308, 312, 316 to be exposed to warmer and higher velocity airflow and/or higher air pressure as compared to other embodiments where the cooler and lower velocity airflow and/or lower air pressure plumes (i.e., plumes 124, 126, 128, 224, 226, 228) envelop, contact, or otherwise intersect refrigerant tubes.

Figure 4:
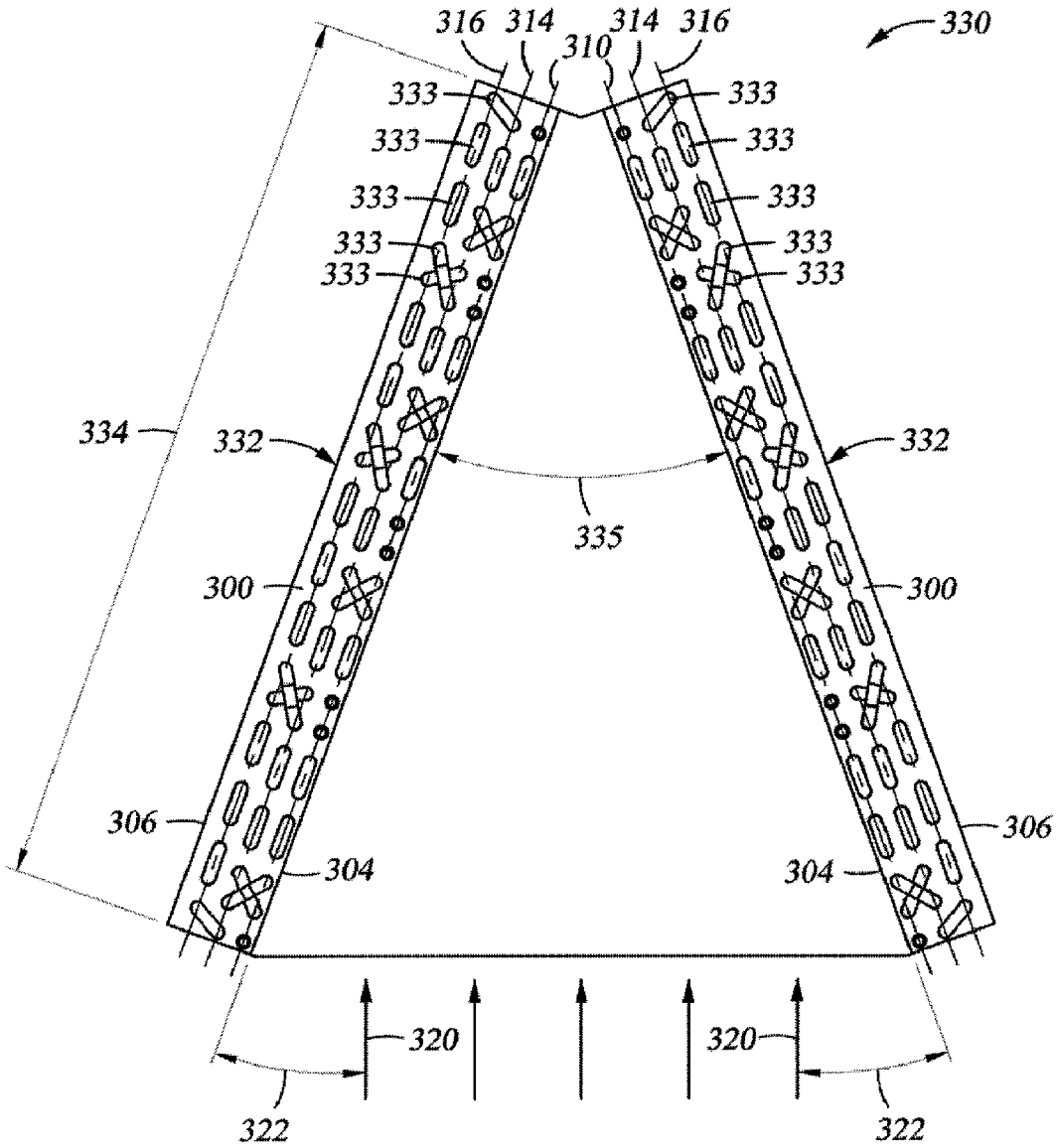
FIG. 4 is a front view of a heat exchanger comprising the fin and tube assembly of FIG. 3.

Referring now to FIG. 4, an end view of a heat exchanger 330 comprising a plurality of fins 300 is shown. The heat exchanger 330 comprises two slabs 332 which each comprise a plurality of fins 300 disposed along the lengths of a plurality of refrigerant tubes 333. In this embodiment, adjacent fins 300 of a single slab 332 are offset from each other along the lengths of the plurality of refrigerant tubes 333 according to a fin pitch of about 14 fins per inch (i.e., an offset distance between adjacent fins 300 of about 0.07143 inches). Of course, in alternative embodiments a fin pitch distance may be different, for example, within a range of about 12 to about 16 fins per inch, or any other suitable fin pitch. Further, it will be appreciated that refrigerant tubes 333 comprise bends, 180° joints, or other connections that join the substantially longitudinal lengths of refrigerant tubes 333 along which fins 300 are primarily disposed. In this embodiment, airflow 320 enters the heat exchanger 330 from between the two slabs 332. In an embodiment, airflow 320 has a velocity in a range of about 100 to about 500 feet per minute, but in alternative embodiments, the heat exchanger 330 may be exposed to any other suitable airflow velocity. The slabs 332 are joined together in a so-called "A-frame" configuration so that leading edges 304 of opposing slabs 332 are not substantially parallel, but rather face each other and are oriented such that an angle of intersection 335 is an acute angle of about twice the value of the angle of incidence 322.

Figure 5:
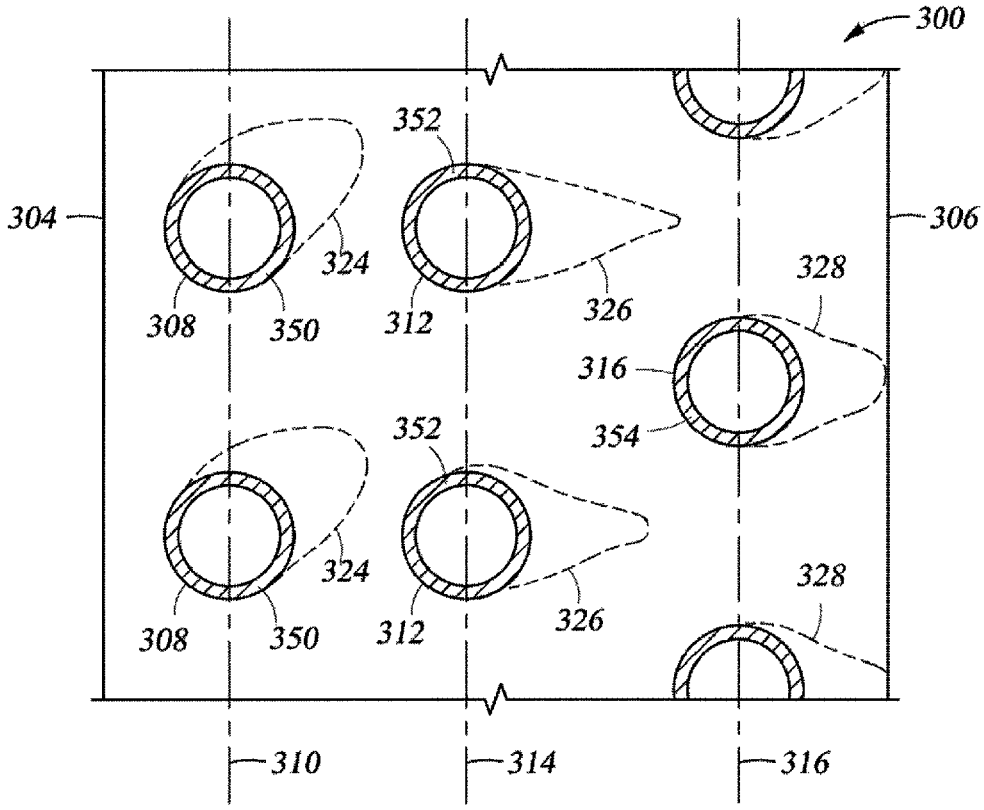
FIG. 5 is a schematic representation of an infrared image generated by an experiment.

Referring now to FIG. 5, a schematic representation of an infrared image of a fin and tube assembly comprising fin 300 under experimental test conditions is shown. The experimental parameters were: a tube spacing of about 1 inch, a row spacing of about 0.866 inches, an entering air temperature of about 80° F., a tube temperature of about 50° F., a fin thickness of about 0.0045 inches, fins comprising aluminum, a tube diameter of about 0.375 inches, an angle of incidence of about 20 degrees, and a plume temperature of about 52° F. FIG. 5 clearly shows that leading plumes 324 extend rightward and upward while secondary plumes 326 and trailing plumes 328 extend primarily rightward. FIG. 5 also clearly indicates that plumes 324, 326, 328 do not intersect or otherwise contact refrigerant tubes 352, 354 that extend through holes 312, 316.

Figure 6:
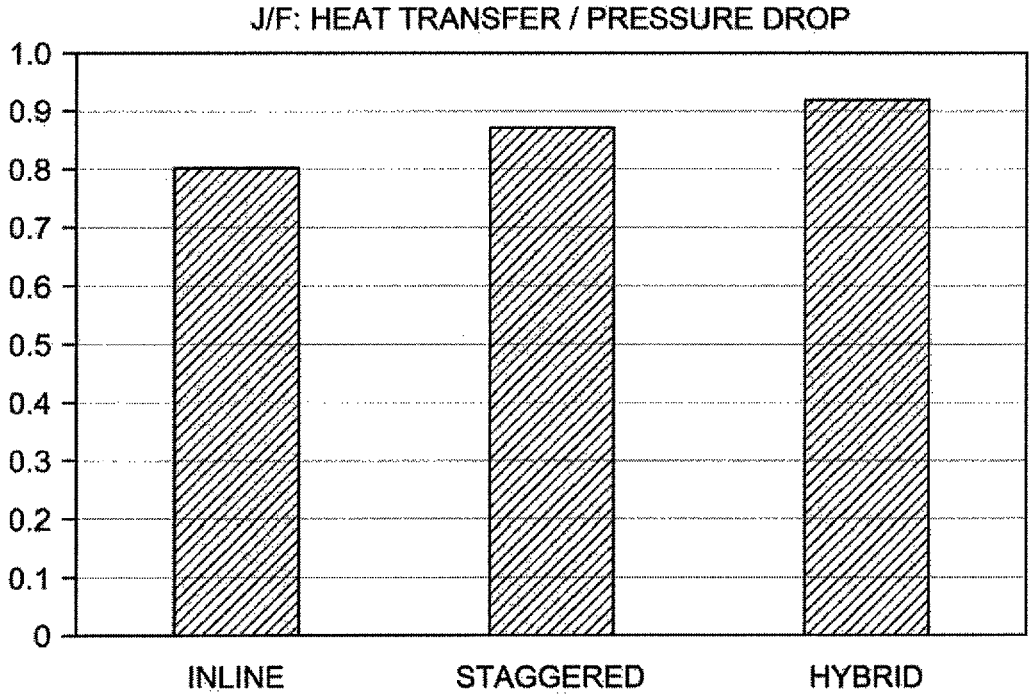
FIG. 6 is a chart comparing heat transfer to pressure drop ratios of various embodiments of heat exchangers.

Referring now to FIG. 6, a chart is provided that presents experimental results of testing heat exchangers comprising fins with in-line hole arrangements (such as fins 100), heat exchangers comprising otherwise identical fins with offset or staggered hole arrangements (such as fins 200), and heat exchangers comprising otherwise identical fins 300 with hybrid hole arrangements. The experimental results represented in the chart of FIG. 6 are ratios of Heat Transfer to Pressure Drop where the heat transfer is the total amount of heat transfer accomplished by the heat exchanger and where pressure drop is the reduction in airflow pressure calculated by subtracting airflow pressure substantially immediately downstream of the heat exchanger from the airflow pressure substantially immediately upstream of the heat exchanger. It should be understood that the results shown as representing a heat exchanger comprising fins 300 also include other fin features that may affect the performance of the heat exchanger. Nonetheless, the chart shows that a heat exchanger comprising fins 300 with hybrid hole arrangements performed superior to heat exchangers comprising fins with either in-line or staggered hole arrangements. Specifically, the heat exchangers comprising fins having hybrid hole patterns yielded a ratio of heat transfer to pressure drop value of slightly more than 0.9. The heat exchangers comprising fins having staggered or offset hole arrangements yielded a ratio of heat transfer to pressure drop value of slightly less than 0.9. Finally, the heat exchangers comprising fins having in-line hole arrangements yielded a ratio of heat transfer to pressure drop value of about 0.8.

Figure 7:
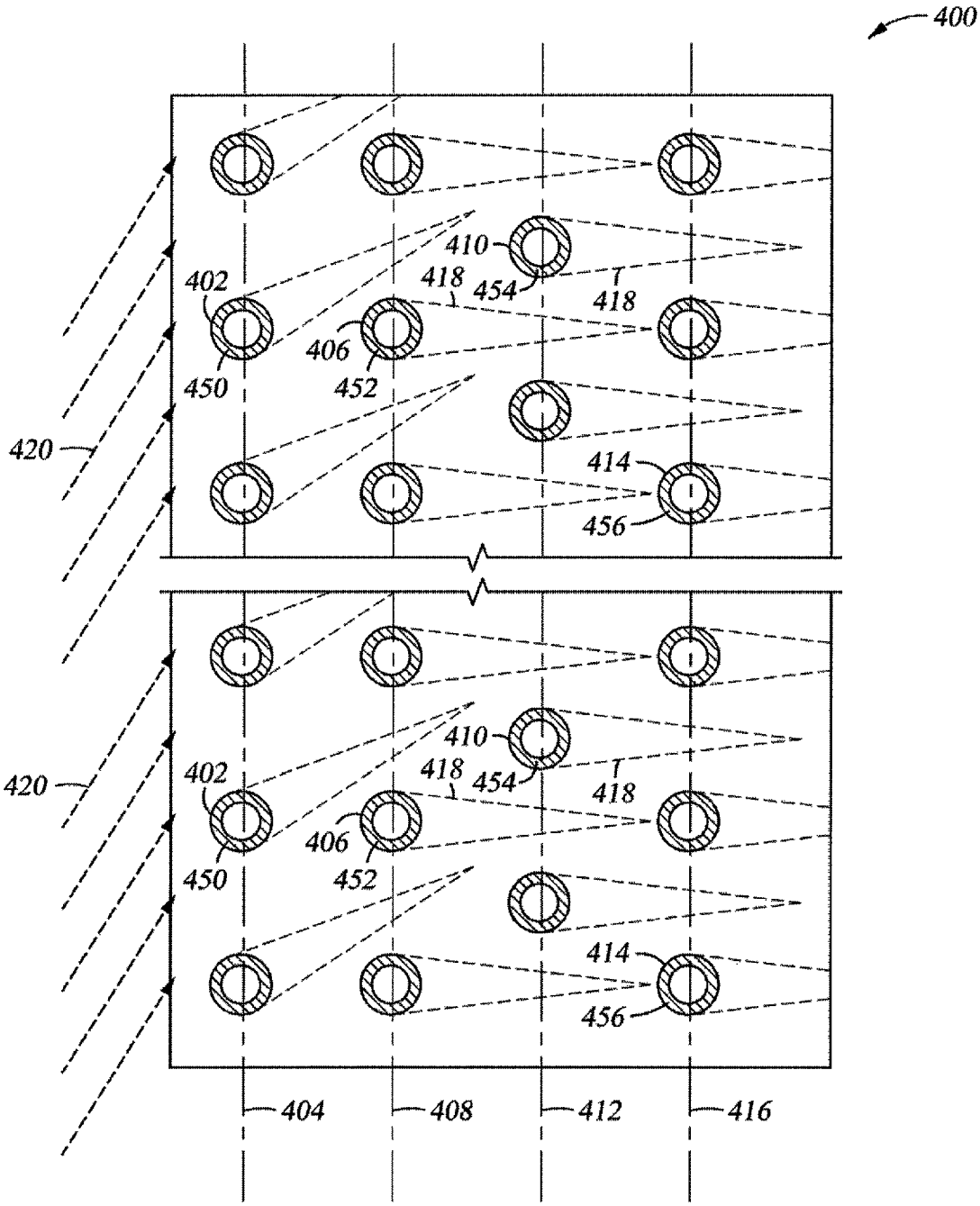
FIG. 7 is a front view of still another fin and tube assembly comprising a fin with a hybrid hole pattern exposed to an airflow having an acute angle of incidence.

Referring now to FIG. 7, a portion of a fin and tube assembly comprising a fin 400 according to an alternative embodiment is shown. Specifically, fin 400 is substantially similar to fin 300 in form and function except that fin 400 further comprises four columns of holes rather than only three columns of holes. Fin 400 comprises leading holes 402 disposed along a leading axis 404, secondary holes 406 disposed along a secondary axis 408, tertiary holes 410 disposed along a tertiary axis 412, and trailing holes 414 disposed along a trailing axis 416. It will be appreciated that leading holes 402 and leading axis 404, secondary holes 406 and secondary axis 408, and tertiary holes 410 and tertiary axis 412 are arranged identically to leading holes 308 and leading axis 310, secondary holes 312 and secondary axis 314, and trailing holes 316 and trailing axis 318, respectively. Further, it will be appreciated that trailing holes 414 and trailing axis 416 are arranged with respect to tertiary holes 410 and tertiary axis 412 in the same manner that trailing holes 316 and trailing axis 318 are arranged with respect to secondary holes 312 and secondary axis 314. Accordingly, each of the plurality of trailing holes 414 are substantially equidistant from the respective two nearest tertiary holes 410. The result of the hybrid hole arrangement of fin 400 is that, as compared to fin 300, the added column of trailing holes 414 are in a staggered or offset arrangement with respect to tertiary holes 410 with no resultant interference of tertiary plumes 418 with trailing holes 414 and/or associated refrigerant tubes 456. In this manner, the number of columns of holes of a fin having a hybrid hole arrangement may be increased. It will be appreciated that fins 200, 300, 400 may comprise aluminum or any other suitable material and that fins 200, 300, 400 may be formed as plate fins.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention. The discussion of a reference in the disclosure is not an admission that it is prior art, especially any reference that has a publication date after the priority date of this application. The disclosure of all patents, patent applications, and publications cited in the disclosure are hereby incorporated by reference, to the extent that they provide exemplary, procedural or other details supplementary to the disclosure.

What is claimed is:

1. A fin, comprising:

a leading edge;

a trailing edge opposing the leading edge;

a plurality of leading holes substantially centered along a leading axis;

a plurality of secondary holes substantially centered along a secondary axis, the secondary axis being substantially parallel to the leading axis and located between the leading axis and the trailing edge, the plurality of secondary holes being located so that the plurality of leading holes and the plurality of secondary holes form a substantially rectangular matrix; and a plurality of trailing holes substantially centered along a trailing axis, the trailing axis being substantially parallel to at least one of the leading axis and the secondary axis and located between the secondary axis and the trailing edge, each of the plurality of trailing holes being substantially equidistant from the respective two nearest secondary holes; a plurality of additional holes substantially centered along an additional axis, the additional axis being substantially parallel to at least one of the leading axis, the secondary axis, and the trailing axis, and located between the trailing axis and the trailing edge, each of the plurality of additional holes being substantially equidistant from the respective two nearest trailing holes;

wherein, other than the plurality of leading holes and the plurality of secondary holes, the portion of the fin between the leading axis and the secondary axis is substantially free of holes that are configured to receive refrigerant tubes therethrough.

2. The fin according to claim 1, wherein each of the plurality of leading holes, secondary holes, and trailing holes are substantially similarly sized.

3. The fin according to claim 1, wherein at least one of the leading edge and the trailing edge are substantially parallel with the leading axis.

4. A heat exchange system, comprising a plurality of the fins of claim 1.

5. The heat exchange system according to claim 4, wherein the leading axes of the plurality of fins are located substantially coaxially, the secondary axes of the plurality of fins are located substantially coaxially, and the trailing axes of the plurality of fins are located substantially coaxially.

6. The heat exchange system according to claim 4, wherein the leading axes of the plurality of fins are located substantially coaxially, the secondary axes of the plurality of fins are located substantially coaxially, the trailing axes of the plurality of fins are located substantially coaxially, and wherein the additional axes of the plurality of fins are located substantially coaxially.

7. The heat exchange system according to claim 4, further comprising:

at least one refrigerant tube extending through at least one of a set of corresponding leading holes, secondary holes and trailing holes of each of the plurality of fins.

8. An air conditioning system, comprising the fin of claim 1.

9. A fin, comprising:

a fin width extending between a leading edge and a trailing edge;

a plurality of leading holes centered along a leading axis;

a plurality of secondary holes positioned along a secondary axis between the leading axis and the trailing edge, each of the plurality of secondary holes substantially aligned with a corresponding one of the plurality of leading holes along a path substantially parallel to the fin width; and a plurality of additional holes positioned between the secondary axis and the trailing edge;

wherein the plurality of additional holes comprises a plurality of tertiary holes positioned along a tertiary axis between the secondary axis and the trailing edge, each of the plurality of tertiary holes being substantially equidistant from the respective two nearest secondary holes; wherein the plurality of additional holes further comprises a plurality of trailing holes positioned along a trailing axis between the tertiary axis and the trailing edge, each of the plurality of trailing holes being substantially aligned with a corresponding one of the plurality of secondary holes along paths substantially parallel to the fin width; and wherein the plurality of leading holes form a first occurring column of holes adjacent the leading edge, wherein the plurality of secondary holes form a second occurring column of holes, and wherein no column of holes configured to receive refrigerant tubing therethrough lies between the first occurring column of holes and the second occurring column of holes.

10. A heat exchange system, comprising a plurality of the fins of claim 9.

11. An air conditioning system, comprising the fin of claim 9.

12. A fin, comprising a leading edge;

a trailing edge opposing the leading edge;

a plurality of leading holes substantially centered along a leading axis;

a plurality of secondary holes substantially centered along a secondary axis, the secondary axis being substantially parallel to the leading axis and located between the leading axis and the trailing edge, the plurality of secondary holes being located so that the plurality of leading holes and the plurality of secondary holes form a substantially rectangular matrix; and a plurality of trailing holes substantially centered along a trailing axis, the trailing axis being substantially parallel to at least one of the leading axis and the secondary axis and located between the secondary axis and the trailing edge, each of the plurality of trailing holes being substantially equidistant from the respective two nearest secondary holes; and a plurality of additional holes substantially centered along an additional axis, the additional axis being substantially parallel to at least one of the leading axis, the secondary axis, and the trailing axis, and located between the trailing axis and the trailing edge, each of the plurality of additional holes being substantially equidistant from the respective two nearest trailing holes;

wherein the leading holes, the secondary holes, the trailing holes, and the additional holes of the leading axis, the secondary axis, the trailing axis, and the additional axis, respectively, form four consecutively located columns of holes.

13. A heat exchange system, comprising a plurality of the fins of claim 12.

14. An air conditioning system, comprising the fin of claim 12.

* * * * *